US008438772B2

(12) United States Patent
Andreis

(10) Patent No.: US 8,438,772 B2
(45) Date of Patent: May 14, 2013

(54) GUN WITH FASTENING FOR SAFETY CORD

(75) Inventor: Ettore Andreis, Brescia (IT)

(73) Assignee: Fabbrica d 'Armi Pietro Beretta S.p.A., Gardone Val Trompia, Bescia (IT)

( * ) Notice: Subject to any disclaimer, the term of this patent is extended or adjusted under 35 U.S.C. 154(b) by 83 days.

(21) Appl. No.: 12/959,908

(22) Filed: Dec. 3, 2010

(65) Prior Publication Data

US 2012/0005933 A1 Jan. 12, 2012

(30) Foreign Application Priority Data

Dec. 16, 2009 (IT) ..... BS2009A0225

(51) Int. Cl.
*F41C 23/00* (2006.01)

(52) U.S. Cl.
USPC ..... 42/85; 42/72; 42/71.01; 42/71.02

(58) Field of Classification Search ..... 42/85, 72, 42/71.01, 71.02, 70.08
See application file for complete search history.

(56) References Cited

U.S. PATENT DOCUMENTS

| | | | | | |
|---|---|---|---|---|---|
| 875,469 | A * | 12/1907 | Tambour | 42/66 |
| 891,748 | A * | 6/1908 | Tambour | 42/70.01 |
| 905,020 | A * | 11/1908 | Tambour | 42/66 |
| 1,118,331 | A * | 11/1914 | Carl | 89/146 |
| 2,945,316 | A * | 7/1960 | Mulno | 42/66 |
| 4,306,487 | A * | 12/1981 | Beretta | 89/148 |
| 4,593,487 | A * | 6/1986 | Ruger et al. | 42/7 |
| 4,672,763 | A * | 6/1987 | Cunningham | 42/70.11 |
| 4,833,811 | A * | 5/1989 | Wilkinson | 42/70.08 |
| 4,845,870 | A * | 7/1989 | Vernon | 42/70.08 |
| 4,967,502 | A * | 11/1990 | Vernon | 42/70.08 |
| 5,323,940 | A * | 6/1994 | Hart | 224/150 |
| 5,361,525 | A * | 11/1994 | Bowes | 42/70.11 |
| 6,178,600 | B1 * | 1/2001 | French | 24/2.5 |
| 6,543,170 | B2 * | 4/2003 | Beretta | 42/70.08 |
| 7,051,468 | B2 * | 5/2006 | Glock | 42/70.06 |
| 7,347,022 | B2 * | 3/2008 | Gussalli Beretta | 42/69.01 |
| 7,467,489 | B2 * | 12/2008 | Gussalli Beretta | 42/72 |
| 7,716,864 | B2 * | 5/2010 | Skrubis et al. | 42/71.01 |
| 7,748,153 | B2 * | 7/2010 | Beretta | 42/71.02 |
| 2002/0088160 | A1 * | 7/2002 | Beretta | 42/70.08 |
| 2006/0096147 | A1 * | 5/2006 | Gussalli Beretta | 42/71.02 |
| 2006/0162222 | A1 * | 7/2006 | Beretta | 42/72 |
| 2008/0244951 | A1 * | 10/2008 | Picard et al. | 42/71.01 |
| 2010/0170133 | A1 * | 7/2010 | Swan | 42/85 |
| 2010/0199541 | A1 * | 8/2010 | Vest et al. | 42/85 |
| 2012/0005933 | A1 * | 1/2012 | Andreis | 42/69.01 |

FOREIGN PATENT DOCUMENTS

| | | |
|---|---|---|
| EP | 1657519 | 5/2006 |

* cited by examiner

*Primary Examiner* — Michelle Clement
(74) *Attorney, Agent, or Firm* — Shoemaker and Mattare

(57) ABSTRACT

A gun comprises a fastening for fastening a safety cord. The fastening is movable between a lowered position and a raised position wherein it defines an accessible opening for fastening the safety cord.

1 Claim, 4 Drawing Sheets

GUN WITH FASTENING FOR SAFETY CORD

BACKGROUND

The present invention relates to a firearm, in particular, a gun fitted with a fastening for a safety cord.

It is known that for security reasons, especially in the military sphere and armed forces, most guns have a ring generally positioned at the bottom of the butt, used to fasten the safety cord, that is a sprung cord, usually in plastic material, which secures the weapon to the belt, so as to prevent it from being subtracted by third parties.

For civilian guns however, especially for sports, there is generally no need for a safety cord.

This leads to some difficulties.

For example, during the manufacturing of the weapon, different procedures and different components need to be used depending on the weapon's final use.

Some users, moreover, despite being in a civilian setting might wish to secure the weapon with a safety cord; this is not generally possible in that civilian weapons, as said, are generally lacking the fastening ring.

SUMMARY OF THE INVENTION

The purpose of the present invention is to produce a firearm, in particular a gun, able to overcome the drawbacks of the prior art and to satisfy the needs spoken of.

Such purpose is achieved by a firearm as described below.

BRIEF DESCRIPTION OF THE DRAWINGS

Further characteristics and advantages of the firearm according to the present invention will be evident from the description below, made by way of a non-limiting example, with reference to the attached drawings wherein.

DESCRIPTION OF THE PREFERRED EMBODIMENT

Figure 1:
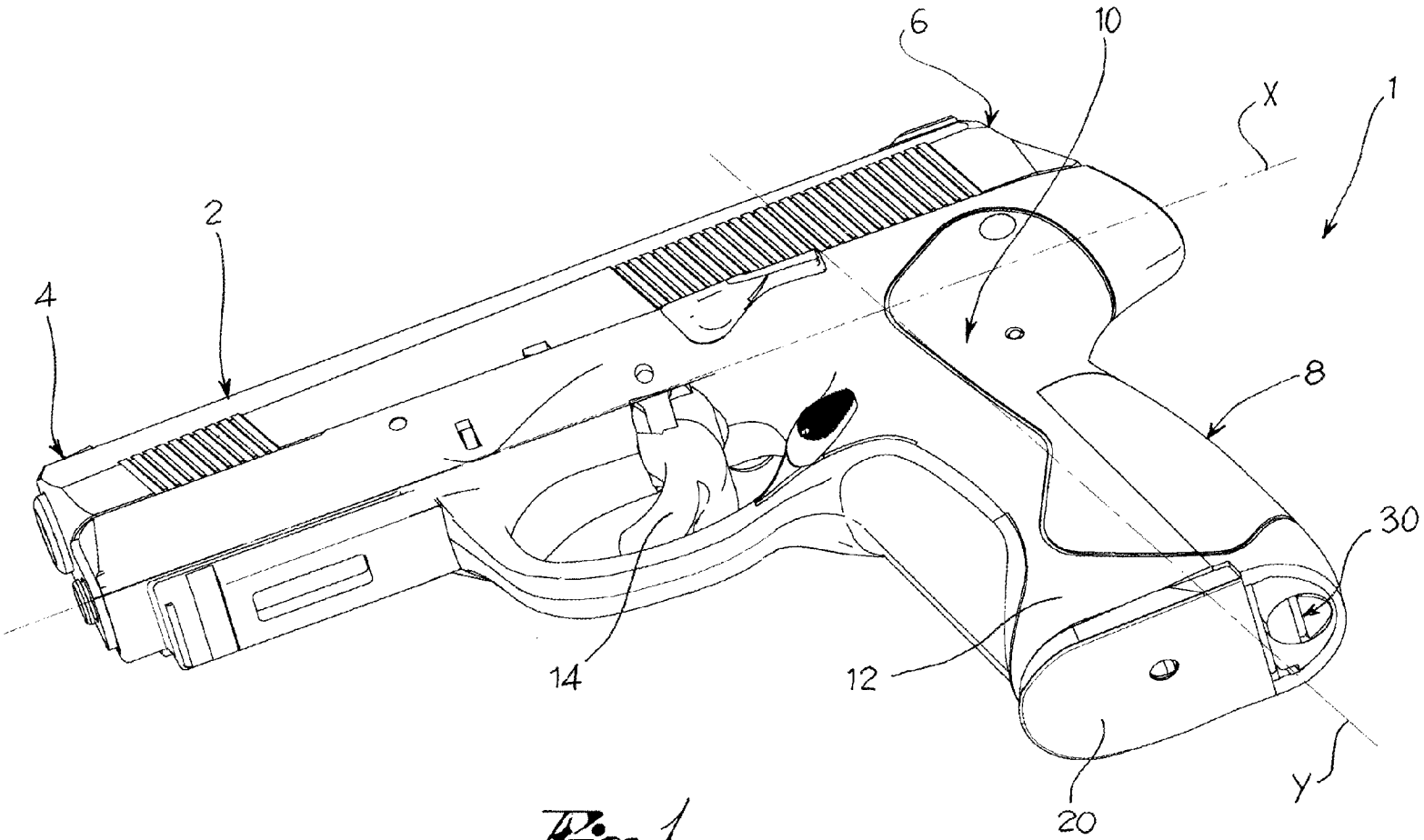
FIG. 1 shows an axonometric view of a gun according to one embodiment of the present invention.

With reference to the attached figures, reference numeral 1 globally denotes a firearm, in particular a gun, fox example a semi-automatic gun.

The gun 1 comprises a barrel 2 extending mainly along a main axis X, between a distal extremity 4, for the exit of the bullet, and an opposite proximal extremity 6.

The gun 1 further comprises a butt 8, projecting from the barrel 2 and connected to it, having its main extension along a secondary axis Y, incident to the main axis X, between a connection portion 10, connected to the barrel 2, near the proximal extremity 6 of the same, and a bottom portion 12, opposite the connection portion.

The gun further comprises a trigger 14 to fire the bullet, and a shooting mechanism, comprising for example a hammer and a firing-pin, activated by the trigger 14.

The butt 8, internally hollow for insertion of the magazine, is closed on the bottom by a detachable closure element 20, forming part of the magazine.

Figure 2A:
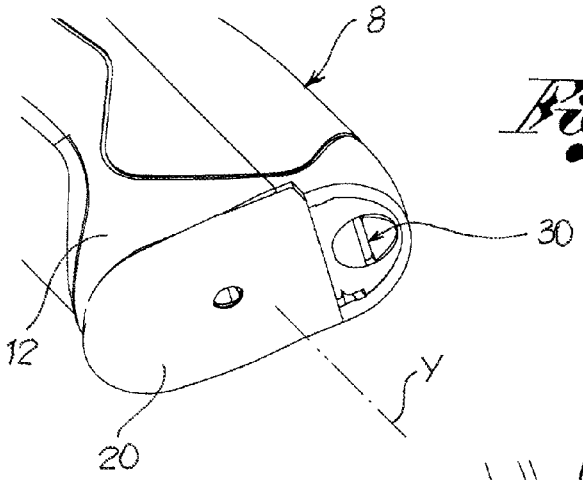
FIGS. 2*a*, 2*b* and 2*c*, 2*d* show the bottom portion of a butt of the gun in FIG. 1, wherein the fastening of the safety cord is respectively in a lowered and raised position.
Figure 2B:
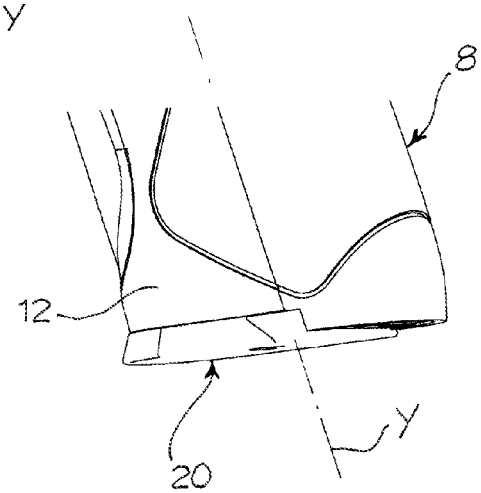
Figure 2C:
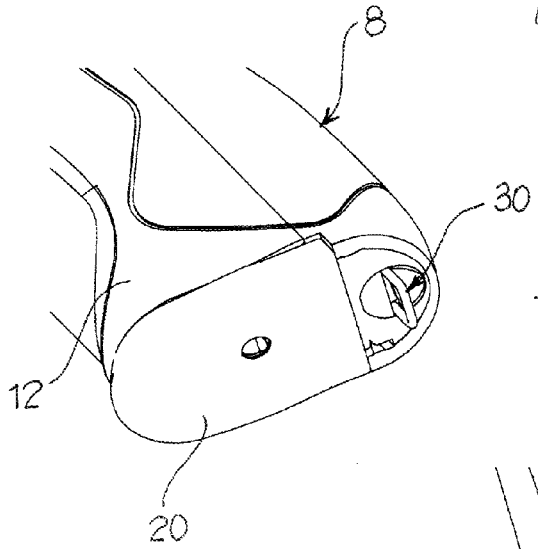
Figure 2D:
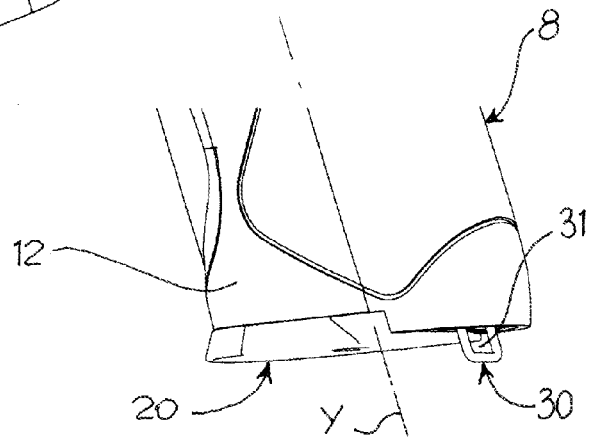
Figure 3:
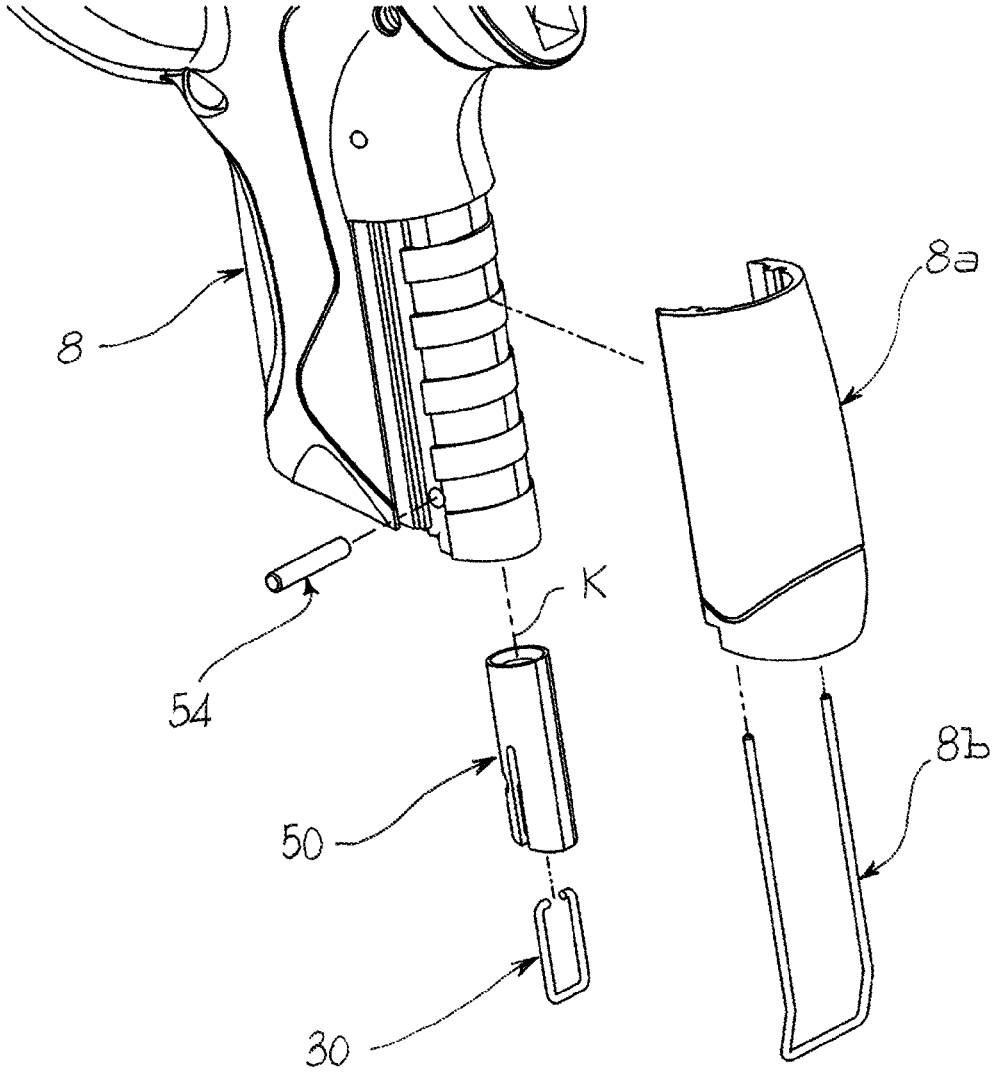
FIG. 3 shows the butt of the gun in FIG. 1, in separate parts.
Figure 4:
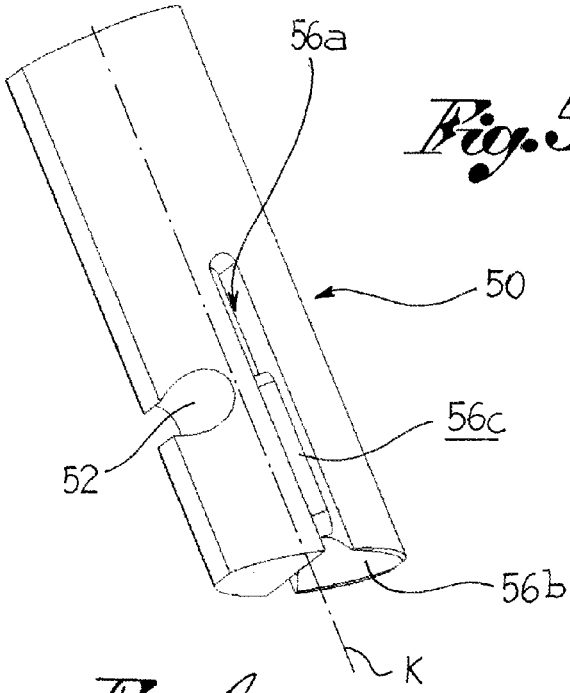
FIG. 4 shows a plug of the gun in FIG. 1.
Figure 5:
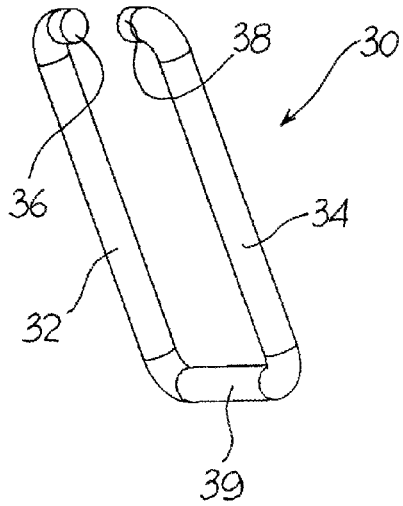
FIG. 5 shows a fastening for a safety cord of the plug in FIG. 4.

The gun 1 further comprises a fastening 30, connected to the butt 8, movable between a raised position (FIGS. 2*c* and 2*d*), wherein it defines an opening 31 for fastening a safety cord, and a lowered position (FIGS. 2*a* and 2*b*).

Preferably, in the raised position, the fastening 30 projects from the butt 8, from the bottom of the butt, closed by the closure element 20.

Preferably, moreover, the butt 8 has a main inner compartment, facing frontwards, to hold the magazine, and an auxiliary compartment, beside the main compartment, facing rearwards, accessible on the bottom of the butt 8.

Preferably, the auxiliary compartment houses a spring, normally compressed so as to constantly influence the hammer of the shooting mechanism.

Preferably, moreover, the butt 8 comprises a rear, interchangeable back-strap 8*a*, connected by means of a fork connection 8*b* element, inserted from the bottom of the butt. Further characteristics of such system are described in document EP1657519 or US2006/096147 by the Applicant.

Moreover, the gun 1 comprises a plug 50, preferably made in plastic, which can be inserted in the auxiliary compartment in the bottom of the butt. The spring of the hammer presses on the plug 50, remaining in compression.

The plug 50, in the form of an element elongated along a plug axis K, coinciding with the direction of insertion of the plug in the auxiliary compartment, has a through housing 52, transversal to the plug axis K, for the insertion of a blocking pin 54.

Once the plug 50 has been inserted in the auxiliary compartment and the spring of the hammer thus placed in compression, the blocking pin 54 is inserted through the sides of the butt, from one side to the other, to block the plug 50 in the auxiliary compartment, against the action of the spring of the hammer.

Preferably, the pin 54 is then covered by the portions of the back-strap 8*a* positioned along the sides of the butt 8.

The fastening 30 is connected to the plug 50 in a movable manner, to pass from the raised position to the lowered position and vice versa.

For example, the plug 50 has two grooves 56*a*, extending along the plug axis K, that is in the direction of insertion of the plug in the butt, joined on the bottom of the plug by a slit 56*b*; preferably the grooves 56*a* are of double depth along their extension, in other words, have an internal abutment step 56*c*.

The fastening 30 is, rather, the shape of a split ring.

For example, the fastening 30 comprises two substantially rectilinear rods 32, 34 with a main extension along the plug axis K; the rods 32, 34 are separate on one side, each terminating in a leg 36, 38, bent like an elbow towards the other, and on the other side are reciprocally joined by a base rod 39.

The fastening 30 is engaged with the plug 50 so that the rods 32, 34 are positioned so as to slide each in its groove 56*a*.

Figure 6A:
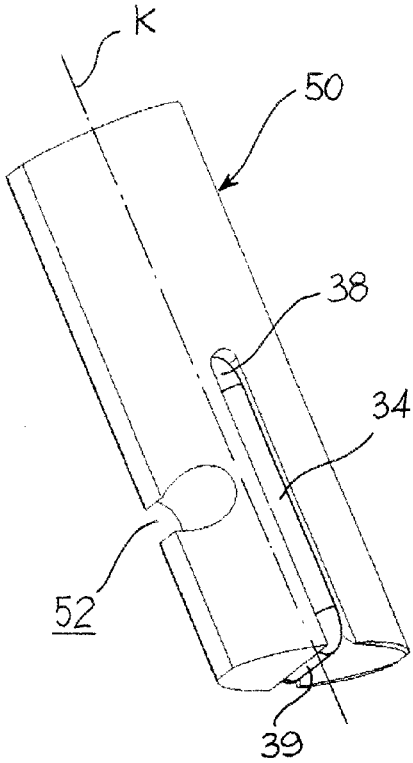
FIGS. 6*a* and 6*b* show the fastening group formed by the plug in FIG. 4 and the fastening in FIG. 5, respectively in a lowered and raised configuration.
Figure 6B:
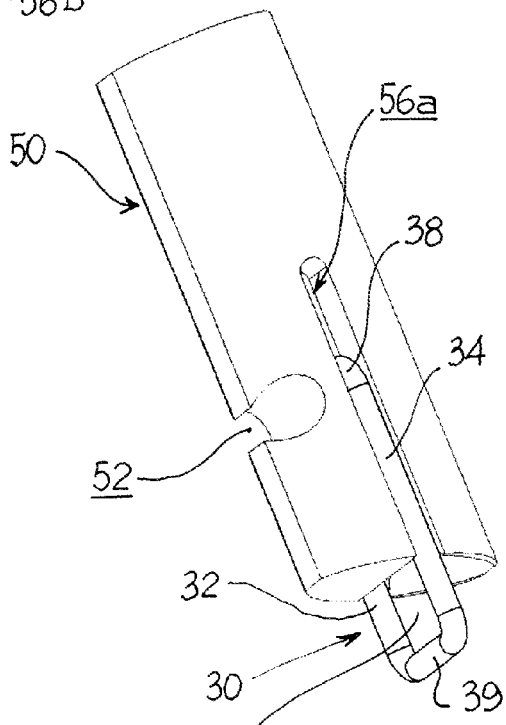

In the lowered position of the fastening 30, the base rod 39 is housed in the slit 56*b* on the bottom of the plug 50 (FIG. 6*a*); in the raised position rather the base rod 39 is distanced from the bottom of the plug, creating the opening 31 for the fastening of the safety cord (FIG. 6*b*).

In the raised limit position, the legs 36, 38 of the fastening 30 abut against the step 56*c* of the groove 56*a*, thereby preventing the detachment of the fastening 30 from the butt.

During normal use of the gun according to the invention, when the user does not wish to fasten the gun to the safety cord, the fastening 30 is placed in the lowered position, practically hidden, in the butt; in this position the fastening does not emerge from the surface of the closure element 20 of the bottom of the butt and is therefore not an encumbrance.

When the user so wishes or is obliged to use the safety cord, all that is required is to place the fastening 30 in the raised position, forming the opening 31 for the fastening of the safety cord.

Innovatively, the gun according to the invention makes it possible to satisfy the requirements spoken of in that both users of civilian weapons and those of military weapons may, as needed, fasten the weapon to the safety cord.

Advantageously, moreover, the production of the gun according to the invention is facilitated, it no longer being necessary to distinguish between guns for military use and guns for civilian use during the manufacturing process.

According to a further advantageous aspect, when the fastening is not used, it does not inconvenience the gun user in that it substantially disappears flush with the surface of the closure element of the butt.

According to yet a further advantageous aspect the plug which the fastening engages with is also the abutment plug of the spring of the hammer, thereby limiting the number of components.

It is clear that a person skilled in the art may make modifications to the gun described above.

For example, according to one embodiment variation (not shown), the fastening is hinged to the plug, so as to be rotated between the raised position and the lowered position.

According to a further variation (not shown), the grooves are made inside the butt, in the walls delimiting the auxiliary compartment and the fastening therefore slides along the walls of the butt.

According to yet a further embodiment variation (not shown), the fastening is rotatable and hinged to the walls of the butt.

Such variations are also contained within the sphere of protection as defined by the following claims.

What is claimed is:

1. In a gun comprising a barrel, a butt connected to the barrel, and a firing mechanism comprising a hammer having a biasing spring, the spring being retained in a compartment in the butt by a plug, on which the biasing spring presses, inserted in the butt to retain the hammer spring, and the plug being retained is said compartment by a transverse blocking pin, the improvement comprising a fastening for receiving a safety cord, wherein the fastening is connected to the plug in a movable manner and is retained by the plug, the fastening being movable manually by a user from a lowered position to a raised position wherein the fastening defines an accessible opening for receiving the safety cord, wherein the fastening comprises two parallel rods interconnected by a base, the rods have respective inwardly bent legs facing toward one another, the plug has longitudinal grooves extending along opposite sides thereof, the parallel rods are slidably seated in said grooves, and said grooves have a first portion of a first depth, a second portion of a second depth, and a step between said first and second portions, so that as long as the plug is retained in the compartment by the blocking pin, the fastening can move only between a retracted position at which the base is flush with the end of the plug, and a deployed position, at which the inwardly bent legs engage said steps.

* * * * *